United States Patent [19]

Stahlecker

[11] Patent Number: 4,606,187

[45] Date of Patent: Aug. 19, 1986

[54] FIBER FEEDING AIR FLOW ARRANGEMENT FOR OPEN-END FRICTION SPINNING

[75] Inventor: Fritz Stahlecker, Josef-Neidhart-Strasse 18, 7347 Bad Überkingen, Fed. Rep. of Germany

[73] Assignees: Hans Stahlecker; Fritz Stahlecker, both of Fed. Rep. of Germany

[21] Appl. No.: 694,779

[22] Filed: Jan. 25, 1985

[30] Foreign Application Priority Data

Feb. 4, 1984 [DE] Fed. Rep. of Germany ..... 3403964

[51] Int. Cl.[4] ..... D01H 7/898; D01H 15/00

[52] U.S. Cl. ..... 57/401; 57/263; 57/411

[58] Field of Search ..... 57/261, 263, 301, 400, 57/401, 22, 408, 411

[56] References Cited

U.S. PATENT DOCUMENTS

| | | | |
|---|---|---|---|
| 4,315,398 | 2/1982 | Parker et al. | 57/401 |
| 4,362,008 | 12/1982 | Parker et al. | 57/401 X |
| 4,367,623 | 1/1983 | Parker et al. | 57/401 X |
| 4,404,792 | 9/1983 | Parker et al. | 57/401 |

*Primary Examiner*—Donald Watkins

*Attorney, Agent, or Firm*—Barnes & Thornburg

[57] ABSTRACT

In the case of an arrangement for open-end friction spinning having two friction rollers that are arranged next to one another to form a wedge-shaped yarn forming gap, the frictional effect is reduced in the area of the yarn tip of the forming yarn. As a result, it is avoided that the yarn tip moves through the wedge-shaped gap. It is also ensured that a fiber transport takes place into this area of the wedge-shaped gap where the yarn tip is formed. This fiber transport is caused by an air current generated by an additional suction device, acting as an extension of the yarn tip.

24 Claims, 3 Drawing Figures

FIBER FEEDING AIR FLOW ARRANGEMENT FOR OPEN-END FRICTION SPINNING

BACKGROUND AND SUMMARY OF THE INVENTION

This invention relates to an arrangement for open-end friction spinning of the type having two friction rollers that are arranged next to one another to form a wedge-shaped gap serving as a yarn-forming zone. The friction rollers are drivable in the same rotational direction. A fiber feeding duct is aimed at the wedge-shaped gap and forms a scatter zone for the feeding of individual fibers. A suction device generates an air current aimed into the wedge-shaped gap in the area of the scatter zone, and a withdrawal device is provided for withdrawing the yarn, the yarn formation starting at a yarn tip at the end thereof opposite the withdrawal direction.

In the case of a known arrangement for open-end friction spinning disclosed in German Unexamined Published Patent Application (DE-OS) No. 29 43 063, one of the two rollers is formed as a so-called suction roller. It has a perforated shell surface within which a suction insert is arranged that is aimed at the wedge-shaped gap by means of a suction slot, said suction insert being connected to a vacuum source. The second roller, on the other hand, has a closed shell surface. A fiber feeding duct aimed at the wedge-shaped gap at an acute angle is equipped with a duct end piece extending in the direction of the wedge-shaped gap in the area in front of its mouth, this duct end piece being connected to an additional suction device. A conveying air current transporting the individual fibers to the wedge-shaped gap is generated inside the fiber feeding duct essentially via the suction of the suction insert passing through the perforated shell surfaces of one of the rollers. The additional air current directly in front of the mouth has the purpose of causing at least some of the conveyed fibers to change the direction of their motion so that the depositing and tieing of the fibers is improved. This additional air current, which is not directed at the area of the forming yarn, has to be proportioned very carefully so that especially light and short fibers are not sucked off. In order to keep the additional air current away from the direct area of the mouth and the area of the wedge-shaped gap, a baffle plate is provided between the additional suction device and the wedge-shaped gap.

The known arrangement as well as other known arrangements which are not provided with an additional suction device have the disadvantage that the yarn, which forms by means of a yarn tip located opposite the withdrawal device, is already very twisted in the area of the yarn tip. This results in a yarn with a hard twisted core and a relatively soft sheath.

The invention is based on the objective of developing an arrangement of the initially mentioned type so that a yarn is obtained that is twisted as evenly as possible, where the twisting of the core of the yarn is not too hard.

This objective is achieved by providing an additional suction device that generates an air current affecting the yarn tip against the withdrawal direction of the yarn.

By means of this development, an air current component is generated in the area of the yarn tip by means of which the air current component aimed into the wedge-shaped gap and caused by the suction device is reduced. Thus the friction effect in the area of the yarn tip is reduced so that in this area the twisting of the forming yarn is reduced which will receive an increased twist only downstream of the yarn tip when it has a larger diameter. However, the conveying direction component of the air current is maintained up to almost directly the wedge-shaped gap so that a sufficient amount of fibers will also reach this area of the forming yarn tip.

In a further development of the invention, it is provided that the friction effect in the area of the yarn tip is reduced because of the design of the rollers and/or of the suction device generating the air current aimed into the wedge-shaped gap. This has the effect that to an increased extend an excessive twisting in the area of the yarn tip is avoided, while the air current generated by the additional suction device ensures the transport of the fibers also to this area.

In a further development of the invention, it is provided that a suction nozzle is provided as the additional suction device that is arranged as an extension of the wedge-shaped gap at the end facing away from the withdrawal device. As a result, it is ensured in a simple manner that the additional air current acts precisely as an extension of the yarn tip.

In the case of another preferred embodiment of the invention, it is provided that the additional suction device is arranged at a distance to the area where the yarn tip is formed and is aimed at the wedge-shaped gap approximately radially, and that means are provided for deflecting the air current in the direction of the wedge-shaped gap. In this manner also, an additional air current is generated in the wedge-shaped gap in the area of the yarn tip which is aimed against the withdrawal direction.

The additional suction device, especially when it is aimed at an acute angle with respect to the conveying direction of the fed fibers, also has the advantage that at least some of the conveying air current can be generated by it which then must not be sucked through the perforated shells of the rollers. In the case of a sharp deflection between the conveying air current and the air current taken in by the additional suction device, the fibers do no follow this deflection or follow it only insignificantly so that they continue to fly into the desired areas of the wedge-shaped gap without problems.

Further objects, features, and advantages of the present invention will become more apparent from the following description when taken with the accompanying drawings which show, for purposes of illustration only, embodiments in accordance with the present invention.

DETAILED DESCRIPTION OF THE DRAWINGS

Figure 1:
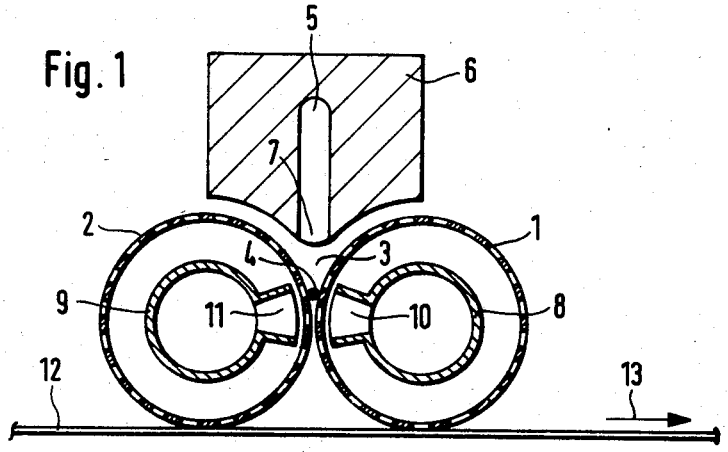
FIG. 1 is a sectional schematic view of an arrangement for open-end friction spinning taken at a radial plane through two rollers froming a wedge shaped gap at the position I—I of FIG. 2, showing a preferred embodiment of the present invention.
Figure 2:
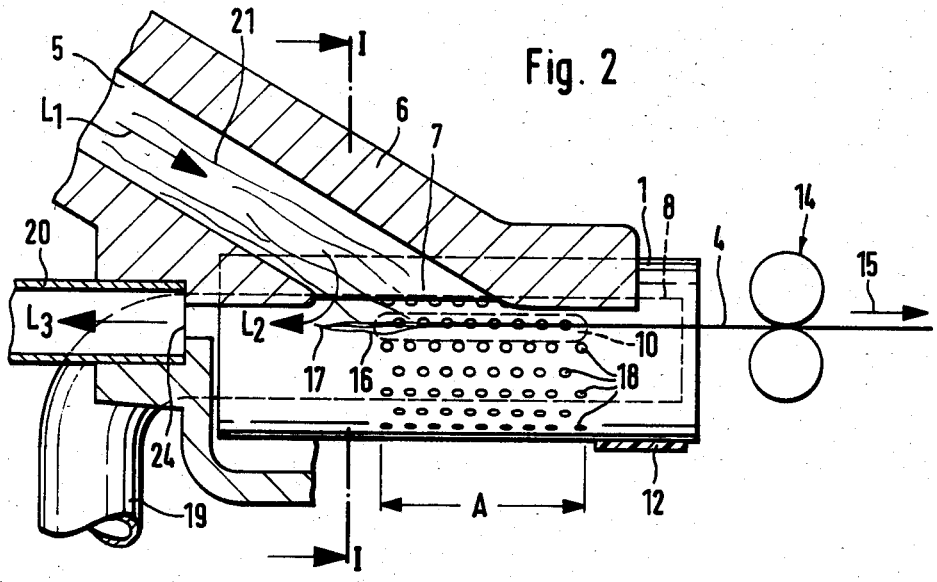
FIG. 2 is a sectional view in the plane of the wedge-shaped gap of the arrangement according to FIG. 1.

In the case of the arrangement for open-end friction spinning according to FIGS. 1 and 2, two friction rollers 1 and 2 are arranged closely next to and in parallel to one another in such a way that they form a wedge-shaped gap 3. The wedge-shaped gap 3, to which fiber material is fed in the form of individuial fibers 21, serves as the yarn forming zone in which the fibers are twisted together to a yarn 4 which is withdrawn in the longitudinal direction (Arrow 15) of the wedge-shaped gap 3 by a pair of withdrawal rollers 14. Subsequently, the yarn 4 is wound onto a spool in a manner that is not shown in detail.

The fiber material that was opened up into individual fibers 21 is led, via a fiber feeding duct, to the area of the wedge-shaped gap 3. The fiber feeding duct 5, which is worked into a housing part 6 which partly covers the friction rollers 1 and 2 in the area of the wedge-shaped gap 3, extends at a right angle with respect to the wedge-shaped gap 3 essentially in the withdrawal direction 15 of the forming yarn 4. The straight fiber feeding duct 5 has a slot-shaped cross-section and opens with its mouth 7 at a narrow distance opposite the wedge-shaped gap 3, said mouth extending in the direction of the wedge-shaped gap 3.

The shells of the friction rollers 1 and 2 each have perforations 18. In a manner that is not shown in detail, friction rollers 1 and 2 are disposed on suction pipes 8 and 9 by means of roller bearings. The suction pipes 8 and 9 are equipped with suction slots 10 and 11 extending in the axial direction, the suction slots 10 and 11 being surrounded by webs projecting up to close to the inside surfaces of the rollers 1 and 2 and being aimed at the area of the wedge-shaped gap 3. The suction pipes 8 and 9 that are closed on one side or end are connected via a connecting pipe 19, at their other side to a vacuum source that is not shown. The driving of the rollers 1 and 2 takes place by means of a tangential belt 12 which runs directly against the shell surfaces of the two rollers 1 and 2 on the outside. By means of such a tangential belt 12 moving in the directrion of the Arrow 13, the rollers 1 and 2 of several or all spinning units of one side of the machine of a spinning machine that is composed of several such units can be driven.

The mouth 7 of the fiber feeding duct 5 forms a scatter zone extending in the longitudinal direction of the wedge-shaped gap 3. The fibers that were separated into individual fibers 21 by a feeding and opening device that is not shown are distributed over the area of this scatter zone. The transport of the fibers 21 in the fiber feeding duct 5 takes place by means of a conveying air current $L_1$. In the scatter zone that corresponds to the length of the mouth 7 of the fiber feeding duct 5, the individual fibers are twisted into the yarn 4. In the process, a yarn tip 16 is formed in the area facing away from the withdrawal device 14, the end 17 of said yarn tip 16 being located approximately in the area of the end of the mouth 7 of the fiber feeding duct 5 facing away from the withdrawal device 14.

As shown in FIG. 2, an additional suction device in the form of a suction nozzle 20 is provided as an axial extension of the wedge-shaped gap 3. Suction nozzle 20 is arranged as a direct and straight extension of the wedge-shaped gap 3 and the mouth 24 of this suction nozzle 20 faces the wedge-shaped gap 3. The suction nozzle 20 which is connected to a vacuum source in a way that is not shown in detail, sucks off the air current $L_3$ which essentially consists of an air current $L_2$ sucked out of the area of the mouth 7 of the fiber feeding duct 5, said air current $L_2$ being deflected at an acute agnle in the area of the mouth 7.

By means of the additional suction device, which in the embodiment according to FIGS. 1 and 2 includes of a suction nozzle 20, several advantages are achieved. The first one is the advantage that the conveying air current $L_1$ does not have to be generated only via the suction device on the inside of the rollers 1 and 2, i.e., via the suction pipe 8 and 9 and their suction slots 10 and 11. At least a considerable part, namely the air current $L_2$, is sucked off by the conveying air current $L_1$ via the suction nozzle 20 as air current $L_3$, Thus it is possible to reduce the air consumption of the arrangement. It is also possible to, if necessary, strengthen the conveying air current $L_1$ in the fiber feeding duct 5 by means of an additional compressed air current introduced from the outside which then must not be removed through the perforations 18 of the rollers 1 and 2. An especially important advantage, however, is the fact that by the deflection of the air current $L_2$, the frictional effect in the area of the yarn tip 16 is reduced without interfering with the fiber transport in this area. By means of the reduction of the frictional effect in the area of the scatter zone taken up by the yarn tip 16, it is prevented that the yarn tip 16 is already strongly twisted so that on the whole a yarn 4 with a softer core is obtained than previously possible in the case of the arrangements for open-end friction spinning. By means of the air current $L_2$ or the air current $L_3$ acting in longitudinal direction against the withdrawal direction 15, the yarn tip 16 is also kept well stretched.

In order to be able to further reduce the frictional effect in the area of the yarn tip 16, it is provided in the embodiment according to FIG. 2 that the perforations 18 of the shell surfaces of the rollers 1 and 2 do not extend to the area in which the yarn tip 16 is formed. The perforation 18 and also the suction slots 10 and 11 start only after aobut $\frac{1}{3}$ of the mouth 7 of the fiber feeding duct 5. They extend over a length A extending beyond the mouth 7 and then forming a strengthening zone for the yarn 4 connecting to the end of the mouth located in the withdrawal direction 15 of the yarn. In the strengthening zone for this yarn, no more fibers 21 are fed to the yarn 4 but the yarn 4 is twisted more extensively.

A reduction of the frictional effect in the area of the scatter zone or of the wedge-shaped gap 3 in which the yarn tip 16 is formed can also be acheived acording to the invention by the fact that the perforations extend also over this area but are formed by individual bores with a smaller cross-section or of bores of less frequency. In addition, it is contemplated for the same purpose to dimension the suction slots 10 and 11 extending into this area corresponding to their cross-section in this area in such a way that there an air current of less strength is generated. Despite all these measures, an air current is generated by the additional suction device in the form of the suction nozzle 20 which ensures that also a sufficient proportion of the fed fibers 21 is deposited in the area of the yarn tip 16 and is tied into the yarn 4.

Figure 3:
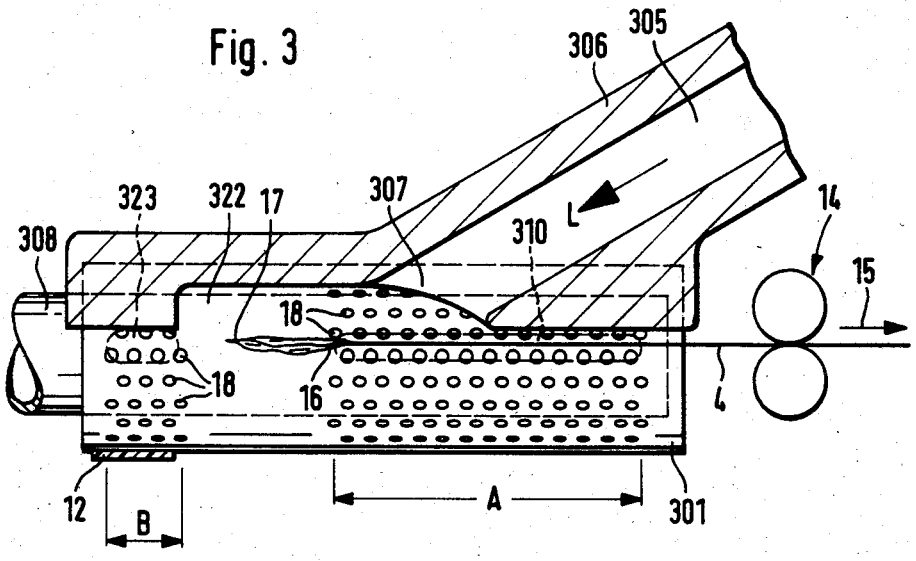
FIG. 3 is a sectional view similar to that of FIG. 2 through another embodiment of an arrangement according to the invention.

The embodiment according to FIG. 3 differs from the embodiment according to FIGS. 1 and 2 because of the fact that the fiber feeding duct 305, which also extends in longitudinal direction of the wedge-shaped gap between two rollers 301 and is worked into a housing 306, is aimed at an acute angle against the withdrawal direction 15 of the yarn 4. This type of feeding and of withdrawal is called "backward-spinning," in contrast to "forward-spinning" according to FIGS. 1 and 2. Also in the case of this embodiment, the frictional effect in the area of the yarn tip 16 is reduced by the fact that in this area, there are no perforations 18 of the rollers 301. The rollers 301 are provided with perforations 18 in area A connecting to the yarn tip 16 in yarn withdrawal direction 15, said perforations 18 extending beyond the end of the mouth 307 facing the withdrawal device 14. Corresponding to this length A, the suction slots 310 of the suction pipes 308 are also dimensioned. However, in order to still achieve a transport of fibers to the area of the yarn tip 16, the rollers 301, at a distance to the end 17 of the yarn tip 16, in the end area facing away from the withdrawal device 14, are provided with another set of perforationa 18 to which in each case a suction slot 323 is assigned that is aimed at the wege-shaped gap. As shown in FIG. 3, the suction slots 323 and 310 may be worked into the same suction pipe 308.

In the area of the suction slots 323, the wedge-shaped gap is covered by the housing part 306 so that the suction air current sucked into the rollers 301 outside the rollers 301 is deflected in the longitudinal direction of the wedge-shaped gap and affects the yarn tip 16 in the longitudinal direction. By means of this additional air current sucked off via the suction slots 323, the same effects are achieved which were described concerning FIG. 2, namely that, on the one hand, the conveying air current is divided and that, on the other hand, sufficient fibers reach the area of the yarn tip 16. As also shown in FIG. 3, the housing part 306, between the suction slots 323 and the mouth 307 of the fiber feeding duct 305 are provided with a recess 322 through which the air current can be deflected in such a way that the fed fibers align themselves better in the longitudinal direction of the wedge shaped gap.

It is also contemplated in the case of the embodiment according to FIG. 3 to proportion the frictional effect in the area of the yarn tip that is exercised by the suction device, i.e. the suction slots 310 and the perforations 18, by the fact that either in this area a perforation is provided having a different cross-section and/or suction slots are provided having a changed cross-section. In addition, it is also contemplated according to other preferred embodiments to provide a suction nozzle in the housing part 306 instead of the suction slots 323 and the perforations located in this area. This suction nozzle may also be aimed radially at the wedge-shaped gap since the air current will also be deflected then by the covering effected by the partial housing 306.

Although the present invention has been described and illustrated in detail, it is to be clearly understood that the same is by way of illustration and example only, and is not to be taken by way of limitation. The spirit and scope of the present invention are to be limited only by the terms of the appended claims.

What is claimed is:

1. An open-end friction spinning unit arrangement comprising:

drivable friction surface means defining a yarn formation zone, said drivable friction surface means generating a friction effect in said yarn formation zone, fiber feeding means including fiber feeding duct means having a mouth opening to a scatter zone at the yarn formation zone, said scatter zone including a yarn tip forming region, yarn withdrawal means for withdrawing yarn from said yarn formation zone in a yarn withdrawal direction, primary suction device means for generating an air current directed toward the area of the scatter zone of the yarn formation zone, and additional suction device means for directing an air flow at the yarn tip forming region for the purpose of reducing the friction effect acting on a yarn tip formed in said yarn tip forming region, said air flow being in a direction opposite the withdrawal direction of the yarn.

2. An arrangement according to claim 1, wherein the additional suction device means includes a suction nozzle that is arranged at the end facing away from the withdrawal device as an extension of the yarn formation zone.

3. An arrangement according to claim 1, wherein the additional suction device means is arranged at a distance to the area where the yarn tip is formed and is aimed approximately radially at the yarn formation zone, and wherein deflecting means are provided for deflecting the air current in the direction of the yarn formation zone.

4. An arrangement according to claim 3, wherein the additional suction device means is arranged outside the mouth of the fiber feeding duct means.

5. An arrangement according to claim 4, wherein the additional suction device means is aimed from the inside in the area of the yarn formation zone at the friction means surface which is covered by a covering that is open in the direction of the mouth of the fiber feeding duct means.

6. An arrangement according to claim 3, wherein the additional suction device means is aimed from the inside in the area of the yarn formation zone at the friction means surface which is covered by a covering that is open in the direction of the mouth of the fiber feeding duct means.

7. An arrangement according to claim 6, wherein a suction pipe is arranged on the inside of said friction surface means, said suction pipe being provided with two suction slots arranged at a distance, between which the area of the yarn formation zone is located where the yarn tip is formed.

8. An arrangement according to claim 3, wherein a suction pipe is arranged on the inside of said friction surface means, said suction pipe being provided with two suction slots arranged at a distance, between which the area of the yarn formation zone is located where the yarn tip is formed.

9. An open-end friction spinning unit arrangement according to claim 1, wherein said drivable friction surface means comprises a pair of adjacently arranged friction rollers drivable in the same rotational direction and said yarn formation zone comprises a wedge-shaped yarn forming gap between the rollers.

10. An arrangement according to claim 9, wherein at least one of the friction rollers and the primary suction device means are configured to reduce the frictional effect in the area of the yarn tip.

11. An arrangement according to claim 10, wherein the suction effect in the primary suction device means in the area of the wedge-shaped gap in which the yarn tip is located is reduced or eliminated compared to the area following in the withdrawal direction of the yarn.

12. An arrangement according to claim 11, wherein the suction effect of the primary suction device means is limited to the area of the wedge-shaped gap connecting to the area where the yarn tip is formed.

13. An arrangement according to claim 12, wherein the additional suction device means includes a suction nozzle that is arranged at the end facing away from the withdrawal device as an extension of the wedge-shaped gap.

14. An arrangement according to claim 10, wherein the suction effect of the primary suction device means is limited to the area of the wedge-shaped gap connecting to the area where the yarn tip is formed.

15. An arrangement according to claim 10, wherein the additional suction device means is arranged at a distance to the area where the yarn tip is formed and is aimed approximately radially at the wedge-shaped gap, and wherein deflecting means are provided for deflecting the air current in the direction of the wedge-shaped gap.

16. An arrangement according to claim 9, wherein the additional suction device means includes a suction nozzle that is arranged at the end facing away from the withdrawal device as an extension of the yarn formation zone.

17. An open-end friction spinning unit arrangement comprising:

a pair of friction rollers arranged adjacent one another to form a wedge-shaped yarn forming gap, said friction rollers being drivable in the same rotational direction, fiber feed means including fiber feeding duct means having a mouth opening to a scatter zone at the yarn forming gap, primary suction device means for generating an air current directed toward the area of the scatter zone of the yarn forming gap, additional suction device means for generating an air current in the area of the yarn tip which is opposite the withdrawal direction of the yarn, said additional suction device means being arranged at a distance to the area where the yarn tip is formed and being aimed approximately radially at the wedge-shaped gap, deflecting means being provided for deflecting the air current in the direction of the wedge-shaped gap, and a suction pipe arranged on the inside of at least one friction roller, said suction pipe being provided with two suction slots arranged at a distance, between which the area of the wedge-shaped gap is located where the yarn tip is formed.

18. An open-end friction spinning unit arranged comprising:

a pair of friction rollers arranged adjacent one another to form a wedge-shaped yarn forming gap, said friction rollers being drivable in the same rotational direction, fiber feeding means including fiber feeding duct means having a mouth opening to a scatter zone at the yarn forming gap, primary suction device means for generating an air current directed toward the area of the scatter zone of the yarn forming gap, additional suction device means for generating an air current in the area of the yarn tip which is opposite the withdrawal direction of the yarn, said additional suction device means being aimed from the inside of the area of the wedge-shaped gap at the perforated shell surface of at least one roller which is covered by a covering that is open in the direction of the mouth of the fiber feeding duct means, said additional suction device means being arranged at a distance to the area where the yarn tip is formed and being aimed approximately radially at the wedge-shaped gap, deflecting means for deflecting the air current in the direction of the wedge-shaped gap, and a suction pipe arranged on the inside of at least one friction roller, said suction pipe being provided with two suction slots arranged at a distance, between which the area of the wedge-shaped gap is located where the yarn tip is formed.

19. A process for spinning yarn in an open-end friction spinning unit comprising:

driving drivable friction surface means for the purpose of creating a friction effect in a yarn formation zone defined by the friction surface means, feeding fibers to said yarn formation zone, generating an air current directed toward said yarn formation zone, directing an air flow at a yarn tip forming region of the yarn formation zone in a direction opposite a yarn withdrawal direction for the purpose of reducing the friction effect in said tip forming region, and withdrawing formed yarn from said yarn formation zone.

20. Process according to claim 19, wherein the drivable friction surface means comprises a pair of adjacently arranged friction rollers and the yarn formation zone comprises a wedge-shaped gap therebetween.

21. A process according to claim 19, wherein the drivable friction surface means is configured to reduce the friction effect in the area of the yarn tip.

22. An arrangement according to claim 21, wherein said air current in the region of the yarn formation zone in which the yarn tip is located is reduced or eliminated compared to the area following in the withdrawal direction of the yarn.

23. A process according to claim 21, wherein said air current is limited to the area of the yarn formation zone connecting to the area where the yarn tip is formed.

24. A process according to claim 21, wherein said air flow is aimed approximately radially at the yarn formation zone, and wherein the air current is deflected in the direction of the yarn formation zone.

* * * * *